US005680102A

United States Patent [19]

Xydis

[11] Patent Number: 5,680,102

[45] Date of Patent: Oct. 21, 1997

[54] RF DATA COMMUNICATION LINK FOR WIRELESS AUDIBLE INDICATION SYSTEM

[75] Inventor: Thomas G. Xydis, Ann Arbor, Mich.

[73] Assignee: Dimango Products, Brighton, Mich.

[21] Appl. No.: 282,719

[22] Filed: Jul. 29, 1994

[51] Int. Cl.[6] ..... G08B 1/08

[52] U.S. Cl. ..... 340/539; 340/825.69; 340/825.72; 340/825.63; 341/176; 455/139

[58] Field of Search ..... 340/825.69, 825.72, 340/825.63; 341/176, 173, 174, 183; 455/139

[56] References Cited

U.S. PATENT DOCUMENTS

| | | | |
|---|---|---|---|
| 3,833,895 | 9/1974 | Fecteaw | 340/505 |
| 4,064,507 | 12/1977 | Schmitz | 340/384.72 |
| 4,191,948 | 3/1980 | Stockdale | 340/539 |
| 4,278,967 | 7/1981 | Tanahashi | 340/539 |
| 4,367,458 | 1/1983 | Hackett | 340/539 |
| 4,520,349 | 5/1985 | Varano | 340/531 |
| 4,523,184 | 6/1985 | Abel | 340/539 |
| 4,560,978 | 12/1985 | Lemelson | 340/539 |
| 4,581,606 | 4/1986 | Mallory | 340/539 |
| 4,641,127 | 2/1987 | Hogan et al. | 379/40 |
| 4,672,365 | 6/1987 | Gehman et al. | 340/539 |
| 4,777,474 | 10/1988 | Clayton | 340/539 |
| 4,821,027 | 4/1989 | Mallory et al. | 340/521 |
| 4,970,494 | 11/1990 | Keely et al. | 340/567 |
| 4,988,980 | 1/1991 | Graham | 340/692 |
| 5,032,836 | 7/1991 | Ono et al. | 340/825.71 |
| 5,061,917 | 10/1991 | Higgs et al. | 340/539 |
| 5,313,199 | 5/1994 | Kwon | 340/825.57 |

OTHER PUBLICATIONS

Fasco Industries Wireless Chime Program, Mar. 15, 1993.

Pamphlet by Dimango Products—Dimango's 1993 Wireless Chime Program.

*Primary Examiner*—Jeffery Hofsass
*Assistant Examiner*—Daryl C. Pope
*Attorney, Agent, or Firm*—Brooks & Kushman P.C.

[57] ABSTRACT

A wireless audible indication system comprising a transmitter and a receiver. An embodiment of the transmitter includes a modulator formed by a microprocessor and a radio frequency oscillator. The modulation format employed is selectable by the user using severable jumper wires. A battery status circuit is included which verifies the status of a battery within the transmitter. The modulator transmits a low battery bit to the receiver in order to alert the user of a weak transmitter battery. An embodiment of the receiver includes a superregenerative detector which produces an intermediate signal upon receiving a radio frequency signal. A signal processing circuit, which includes an active peak detector stage and a discrete comparator stage, is used to process the intermediate signal. A microprocessor controls a sound generator circuit in response to the processed intermediate signal. The microprocessor, which normally operates in an inactive mode, is awaken using a wake-up circuit upon reception of the radio frequency signal. A battery status circuit is included to verify the status of a battery within the receiver. Embodiments of the transmitter and receiver employ a pulse position modulation scheme.

16 Claims, 7 Drawing Sheets

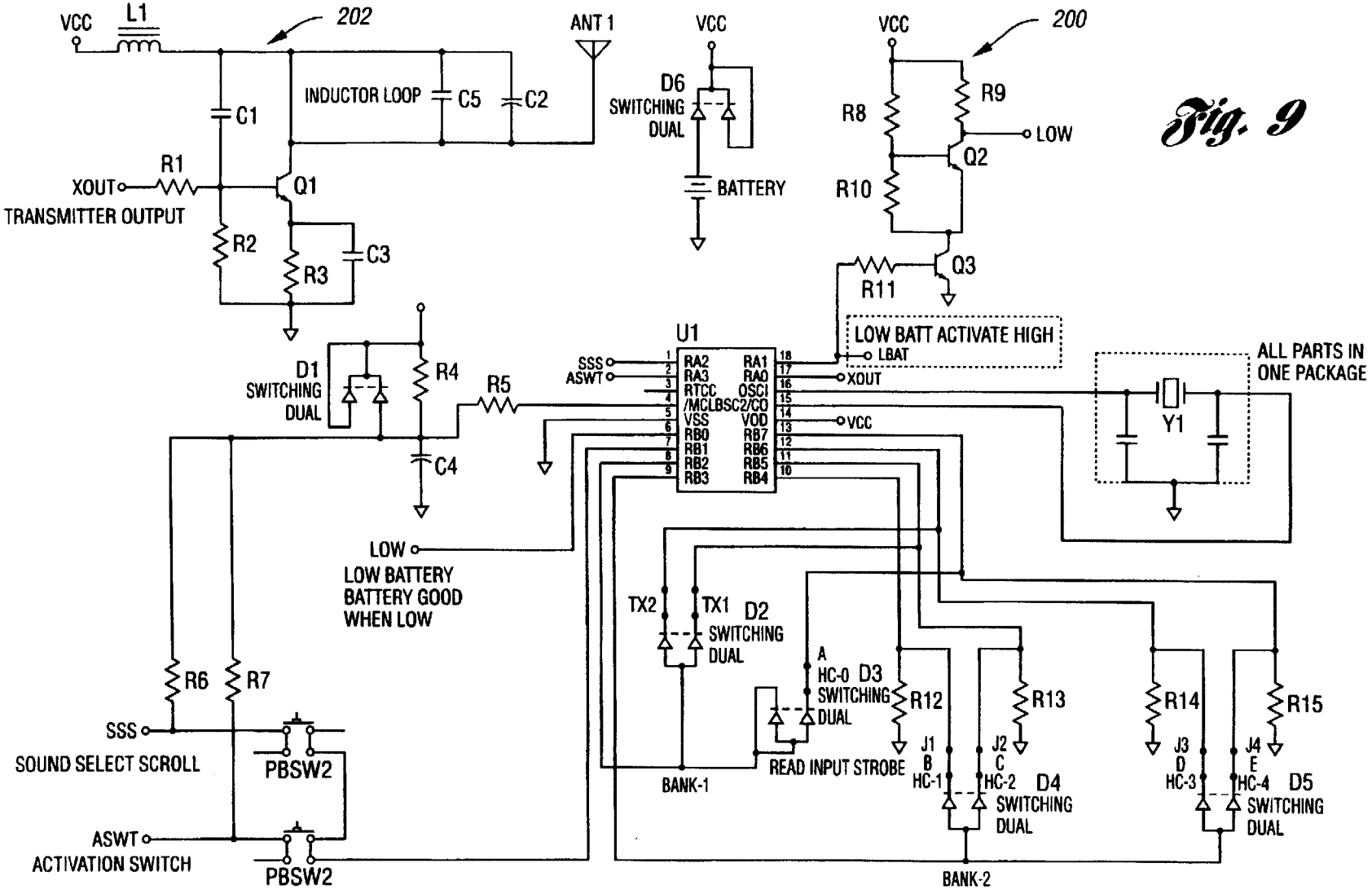
Fig. 9
200
202
VCC
R9
R8
R10
LOW
Q2
Q3
R11
LOW BATT ACTIVATE HIGH
LBAT
XOUT
ALL PARTS IN ONE PACKAGE
Y1
U1
RA1
RA0
OSC1
RTCC
/MCLR
OSC2/CO
VDD
RB7
RB6
RB5
RB4
RA2
RA3
VSS
RB0
RB1
RB2
RB3
SSS
ASWT
R15
R14
R13
R12
J4
J3
J2
J1
E
D
C
B
HC-4
HC-3
HC-2
HC-1
D5
D4
SWITCHING
DUAL
BANK-2
A
HC-0
D3
READ INPUT STROBE
TX1
TX2
D2
BANK-1
D6
BATTERY
ANT 1
C2
C5
INDUCTOR LOOP
C3
Q1
R3
R2
C1
L1
R1
XOUT
TRANSMITTER OUTPUT
R5
R4
C4
D1
LOW
LOW BATTERY
BATTERY GOOD
WHEN LOW
R7
R6
PBSW2
SSS
SOUND SELECT SCROLL
ASWT
ACTIVATION SWITCH

RF DATA COMMUNICATION LINK FOR WIRELESS AUDIBLE INDICATION SYSTEM

TECHNICAL FIELD

The present invention relates generally to doorbell systems, and particularly to wireless doorbell systems which employ radio frequency transmitters and receivers.

BACKGROUND OF THE INVENTION

Wireless doorbell systems have become an increasingly popular option for persons wishing either to replace their current doorbell or to add additional doorbell buttons at their place of residence. A general wireless doorbell system comprises at least one battery-operated, radio-frequency transmitter and a radio-frequency receiver. In response to the depression of a button on the transmitter, a radio-frequency signal is transmitted for reception by the receiver. The receiver alerts the user that the doorbell button has been depressed by producing an audible signal, such as a tone or a melody, upon detecting the transmitted radio-frequency signal.

The installation of a battery-powered wireless doorbell system is performed by simply inserting batteries into the transmitter and receiver, and mounting them at their desired locations. Because no wiring is required between the transmitter and the receiver, the resulting installation of a wireless doorbell system is a relatively easy task. This ease in installation partially accounts for the popularity of wireless doorbell systems.

One drawback of using a battery-operated wireless doorbell system is that the batteries in the transmitter and receiver must be replaced when they are insufficiently powered. In practice, the transmitter batteries need not be replaced as often as the receiver batteries. This is due to the fact that the receiver consumes battery power continually in determining whether or not a radio-frequency signal was transmitted, whereas the transmitter consumes battery power only when its button has been depressed. Typically, the batteries in the receiver need to be replaced after a number of months of operation.

Another drawback of previous wireless doorbell systems is their sensitivity to both noise and interference from other Part 15 transmitters.

SUMMARY OF THE INVENTION

For the foregoing reasons, the need exists for a wireless doorbell system having an extended battery life and improved immunity to noise and interference.

It is thus an object of the present invention to extend the battery life in a wireless doorbell receiver.

Another object of the present invention is to replace operational amplifier based circuits in a receiver with low power consuming transistor-based circuits.

A further object is to provide a transmitter which can communicate with a variety of different doorbell receivers.

A still further object is to provide an improved modulation format for communication between the transmitter and the receiver.

In carrying out the above objects, the present invention provides a receiver for use in an audible indication system with a corresponding transmitter capable of transmitting a radio frequency signal. A radio frequency detector produces an intermediate signal upon receiving the radio frequency signal from the corresponding transmitter. A demodulator forms a discrete signal from the intermediate signal by comparing a first quantity, representative of the behavior of the intermediate signal during a predefined first time interval, to a second quantity, representative of the behavior of the intermediate signal during a predefined second time interval. A sound generator generates an audible indication in dependence upon the discrete signal.

In carrying out the above objects, the present invention further provides a receiver for use in a wireless actuator system with a corresponding transmitter capable of transmitting a radio frequency signal. A radio frequency detector produces an intermediate signal upon receiving the radio frequency signal from the corresponding transmitter. A demodulator, coupled to the radio frequency detector, forms a discrete signal by comparing a first quantity to a second quantity, wherein the first quantity is representative of the behavior of the intermediate signal during a predefined first time interval and the second quantity is representative of the behavior of the intermediate signal during a predefined second time interval. An actuator, coupled to the demodulator, actuates a device in dependence upon the discrete signal.

In carrying out the above objects, the present invention still further provides a transmitter for use in an audible indication system. The transmitter includes a modulator capable of producing a first radio frequency signal in a first modulation format, and further capable of producing a second radio frequency signal in a second modulation format. A format selector, coupled to the modulator, allows a selection of at least one format of the first modulation format and the second modulation format. The transmitter communicates with at least one of a first corresponding receiver and a second corresponding receiver based upon the selection of the at least one format, wherein the first corresponding receiver is capable of producing an audible indication in response to receiving the first radio frequency signal, and wherein the second corresponding receiver is capable of producing an audible indication in response to receiving the second radio frequency signal.

In carrying out the above objects, the present invention further provides a receiver for use in an audible indication system with a corresponding transmitter capable of transmitting a radio frequency signal. A radio frequency detector produces an intermediate signal upon receiving the radio frequency signal from the corresponding transmitter. A demodulator, coupled to the radio frequency detector, forms a discrete signal by comparing a first quantity to a second quantity, wherein the first quantity is representative of the energy of the intermediate signal during a predefined first time interval and the second quantity is representative of the energy of the intermediate signal during a predefined second time interval. Further, the first time interval and the second time interval are nonoverlapping within a predetermined bit interval. A sound generator generates an audible indication in dependence upon the discrete signal. The demodulator rejects the radio frequency signal if the first quantity exceeds a first threshold and the second quantity exceeds a second threshold. Further, the demodulator senses a stop signal when the first quantity is less than a third threshold and the second quantity is less than a fourth threshold.

These and other features, aspects, and advantages of the present invention will become better understood with regard to the following description, appended claims, and accompanying drawings.

BRIEF DESCRIPTION OF THE DRAWINGS

FIG. 9 is a schematic drawing of an embodiment of a transmitter.

BEST MODES FOR CARRYING OUT THE INVENTION

Figure 1:
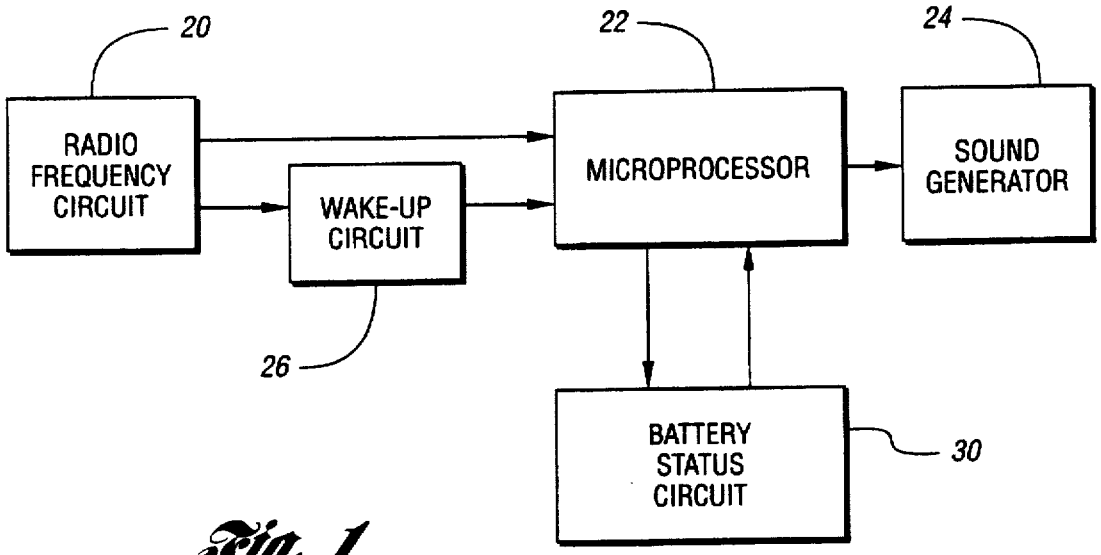
FIG. 1 is a block diagram of an embodiment of a receiver in accordance with the present invention.

Turning now to FIG. 1, a block diagram of an embodiment of a receiver for use in an audible indication system, such as a doorbell system, is illustrated. A radio frequency (RF) circuit 20 operates to receive and process a radio frequency signal from a corresponding transmitter. The RF circuit 20 includes a radio frequency detector which produces an intermediate signal upon receiving the radio frequency signal from the corresponding transmitter. Also included in the RF circuit 20 is a signal processing circuit which produces a processed signal in dependence upon the intermediate signal. The signal processing circuit typically includes a series of one or more cascaded stages, such as a peak detector stage and a comparator stage.

The processed signal from the RF circuit 20 is applied to a microprocessor 22. The signal processing circuit in the RF circuit 20 along with the microprocessor 22 form a demodulator for the receiver, wherein a discrete, demodulation signal is produced. The discrete signal from the microprocessor 22 is applied to a sound generator 24. The sound generator 24 generates an audible indication in dependence upon the discrete signal.

A wake-up circuit 26 produces a wake-up signal in response to receiving the radio frequency signal in the RF circuit 20. The wake-up signal is applied to the microprocessor 22, which normally operates in a low-current, inactive mode. Upon receiving the wake-up signal, the microprocessor 22 becomes active. A battery status circuit 30 monitors the status of a battery in the receiver upon receiving an activation signal from the microprocessor. In response to the activation signal, the status of the battery is communicated to the microprocessor 22. If the battery is becoming insufficiently powered, then an additional audible indication is generated by the sound generator 24.

Figure 2:
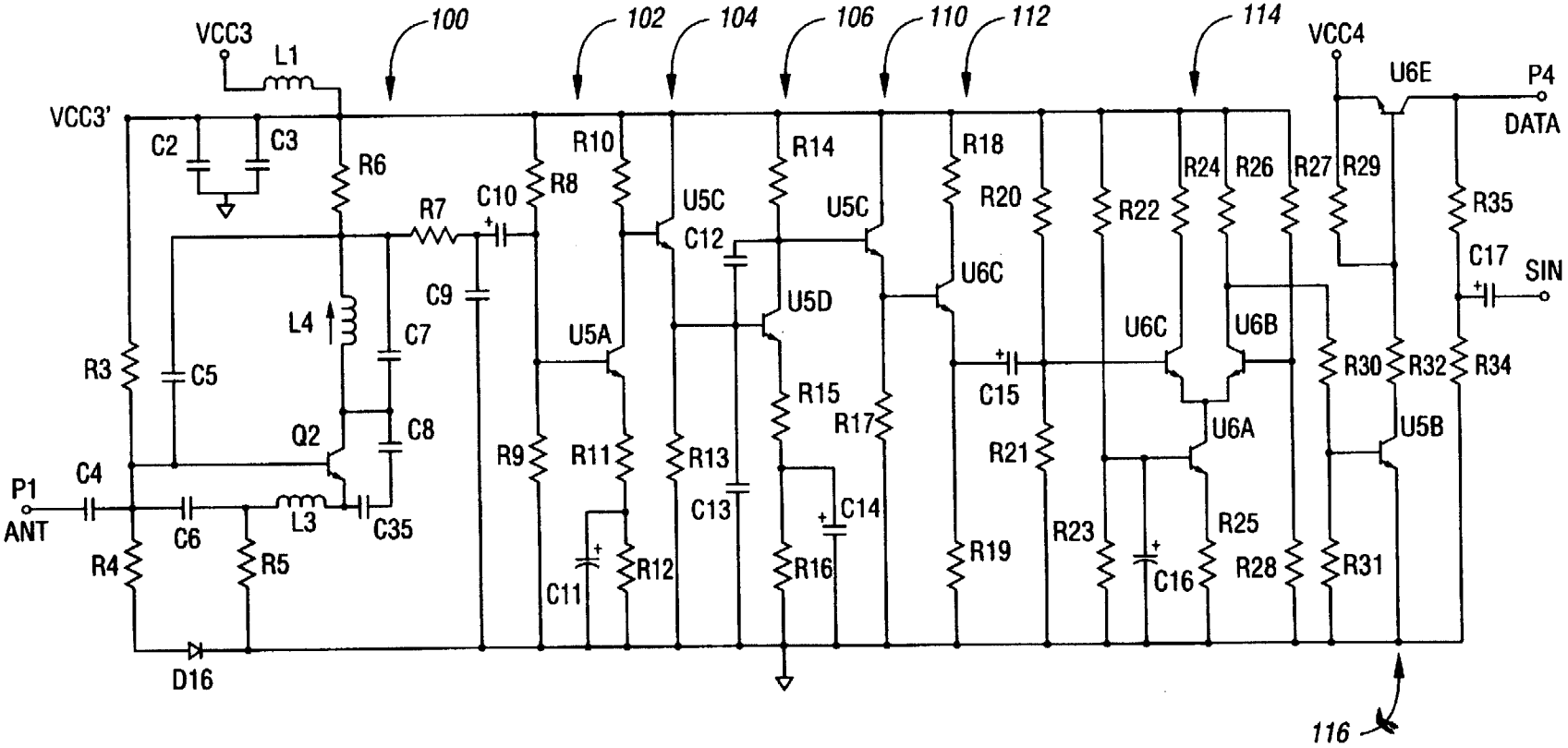
FIG. 2 is a schematic diagram of an embodiment of an RF circuit in accordance with the present invention.

A schematic drawing of an embodiment of a radio frequency (RF) circuit is illustrated in FIG. 2. A radio frequency superregenerative detector 100, which comprises capacitors C2, C3, C4, C5, C6, C7, C8, C9, and C35, resistors R3, R4, R5, and R6, inductors L1, L3, and L4, a transistor Q2, and a diode D16, is located at the front end of the radio frequency circuit. The superregenerative detector provides wide band detection and demodulation of amplitude modulated transmissions about a preselected carrier frequency. The preselected carrier frequency corresponds to the carrier frequency of a transmitter designed for use with the receiver. In a preferred embodiment, the superregenerative detector is tuned to 315 MHz.

The output of the superregenerative detector 100 is coupled to a common emitter amplifier 102 by a Coupling capacitor C10. The common emitter amplifier 102 comprises a transistor U5A, resistors R8, R9, R10, R11, and R12, and a capacitor C11. The resistor R8 is connected between the base of the transistor U5A and the VCC3' supply line. The resistor R9 is connected between the base of the transistor U5A and ground. As a result, the resistors R8 and R9 form a voltage divider bias for the base of the transistor U5A. The collector of the transistor U5A is coupled to VCC3' by the resistor R10. The resistor R11, which acts as a swamping resistor, is connected between emitter of the transistor U5A and a parallel combination of the resistor R12 and the capacitor C11 to ground. The capacitor C11 acts as a bypass capacitor for the amplifier 102.

The output of the common emitter amplifier 102, located at the collector of the transistor U5A, is directly coupled to a peak detector circuit 104. The peak detector circuit 104 is comprised of a transistor U5E, a resistor R13, and a capacitor C13. The base of the transistor U5E is coupled to the collector of the transistor U5A in the common emitter amplifier 102. The collector of the transistor U5E is connected to VCC3' The emitter of the transistor U5E is coupled to ground by a parallel combination of the resistor R13 and the capacitor C13. The peak detector 104 acts to filter out a characteristic noise which is induced by the superregenerative detector 100.

The output of the peak detector circuit 104, located at the emitter of the transistor U5E, is directly coupled to a low pass filter circuit 106. The low pass filter circuit 106 comprises a transistor U5D, resistors R14, R15, and R16, and capacitors C12 and C14, connected in a common emitter configuration. The base of the transistor U5D is connected to the emitter of the transistor U5E of the peak detector circuit 104. The capacitor C12 is connected between the base and the collector of the transistor U5D. The collector of the transistor U5D is coupled to VCC3' by the resistor R14. The emitter of the transistor U5D is coupled to ground by the resistor R15 in series with a parallel combination of the resistor R16 and the capacitor C14. The capacitor C14 acts as a bypass capacitor, while the resistor R15 acts as a swamping resistor for degeneration of the emitter.

The output of the low pass filter 106, located at the collector of the transistor U5D, is directly coupled to a level translation circuit 110. The level translation circuit 110 comprises a transistor U5C and a resistor R17. The base of the transistor U5C is directly coupled to the collector of the transistor U5D. The collector of the transistor U5C is connected to VCC3'. The resistor R17 is connected between the emitter of the transistor U5C and ground. In comparison to the signal present at the base of the transistor U5C, the signal at the emitter has a DC level shifted down by the threshold voltage of the base-emitter junction.

The output of the level translation circuit 110, located at the emitter of the transistor U5C, is directly coupled to a PNP common emitter amplifier 112. The PNP common emitter amplifier 112 comprises a PNP transistor U6D, and resistors R18 and R19. The collector of the transistor U6D is directly coupled to the emitter of the transistor U5C. The resistor R18 connects the emitter of the transistor U6D to VCC3'. The resistor R19 connects the collector of the transistor U6D to ground. As a result, the DC level of the signal present at the collector of the transistor is equal to the product of the quiescent emitter current and the resistance of the resistor R19.

The output of the common emitter amplifier 112, located at the collector of the PNP transistor U6D, is coupled by a capacitor C15 to a discrete comparator circuit 114. The discrete comparator circuit 114, which comprises transistors U6A, U6B, and U6C, resistors R20, R21, R22, R23, R24, R25, R26, R27, and R28, is used to detect received pulses which appear at the base of the transistor U6C. The resistor R20 is connected between the base of the transistor U6C and the VCC3' supply line. The resistor R21 is connected between the base of the transistor U6C and ground. Consequently, the resistors R20 and R21 form a voltage divider used to bias the base of the transistor U6C. A similar voltage divider formed by the resistor R27, connected between the base and VCC3, and the resistor R28, connected between the base and ground, is used to bias the base of the transistor U6B. The collectors of the transistors U6C and U6B are coupled to the VCC3 supply line by the resistors R24 and R26, respectively. The emitters of the transistors U6C and U6B are directly coupled in order to form a differential pair.

A constant current source, formed by the transistor U6A, the capacitor C16, and the resistors R22, R23, and R25, is coupled to the emitters of the transistors U6C and U6B to provide a quiescent current thereto. More specifically, a voltage divider formed by the resistor R22, connected between the base of the transistor U6A and VCC3, and the resistor R23, connected between the base and ground, is used to bias the transistor U6A. The capacitor C16 is connected between the base and ground in order to provide improved stability in the current source. The emitter of the transistor U6A is connected to ground by the resistor R25.

The output of the discrete comparator circuit 114, located at the collector of the transistor U6B, is coupled to a level translation circuit 116. The level translation circuit 116, which comprises an NPN transistor U5B, a PNP transistor U6E, resistors R29, R30, R31, R32, R33, and R34, is employed to translate the voltage levels of received pulses for application to a subsequent microprocessor circuit. A series combination of the resistor R30 and the resistor R31 is connected between the collector of the transistor U6B and ground. The base of the NPN transistor U5B is connected at the juncture of the resistors R30 and R31. The emitter of the NPN transistor U5B is connected to ground. The resistor R32 is connected between the collector of the NPN transistor U5B and the base of the PNP transistor U6E. The resistor R29 is connected between the emitter and the base of the PNP transistor U6E. The emitter of the PNP transistor U6E is applied to a second voltage supply line VCC6. A series combination of the resistor R33 and the resistor R34 is connected between the collector of the PNP transistor U6E and ground. The level translated output, indicated by the DATA line on the schematic, is located at the collector of the PNP transistor U6E. At the juncture of the series combination of the resistors R33 and R34 is a capacitor C17 which couples the RF circuit to a subsequent wake-up circuit by the SIN line indicated on the schematic drawing.

In a preferred embodiment of the RF circuit, the transistors U5A, U5B, U5C, U5D, and U5E are located on a common transistor array integrated circuit, such as a CA3083. Similarly, the transistors U6A, U6B, U6C, U6D, and U6E are located on a common transistor array integrated circuit, such as a CA3096. It is noted that discrete transistors can also be employed.

Figure 3:
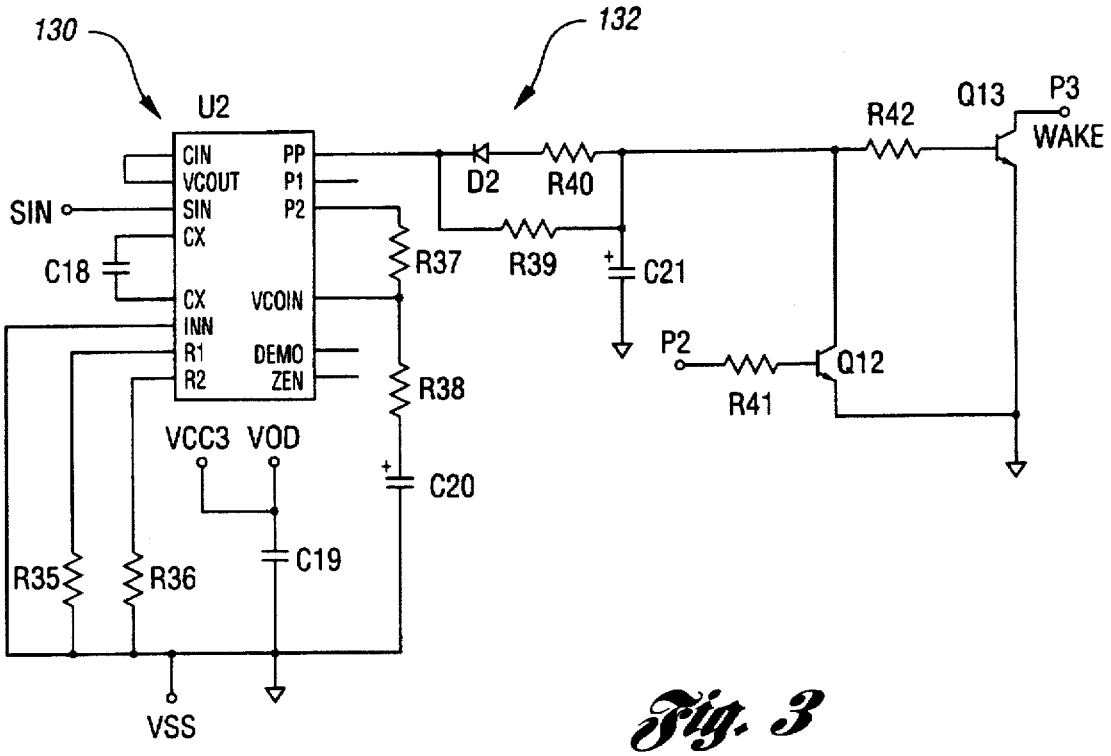
FIG. 3 is a schematic drawing of an embodiment of a wake-up circuit in accordance with the present invention.

An embodiment of a wake-up circuit in accordance with the present invention is illustrated by the schematic drawing in FIG. 3. The signal present at the SIN line in FIG. 2 is applied to a phase locked loop (PLL) 130. The PLL 130 includes a PLL integrated circuit U2, such as an MC14046, wired in a standard configuration. The signal at the SIN line is applied to a first comparator input at pin 14 of the PLL IC U2. The range of frequencies for which the PLL IC U2 will lock is dependent upon an external timing capacitor C18 connected between pins 6 and 7, a resistor R35 connected between pin 11 and ground, and a resistor R36 connected between pin 12 and ground. In a preferred embodiment, the PLL is designed to lock for a 1 kHz tone. The input of the VCO at pin 9 is coupled to a phase comparator output at pin 13 by a resistor R37. Further, the input of the VCO is coupled to ground by a series combination of a resistor R38 and a capacitor C20. As a result, the capacitor C20 and the resistors R37 and R38 form a loop filter for the PLL 130. The output of the VCO at pin 4 is directly coupled to a second comparator input at pin 3. The input inhibit at pin 5 is grounded. A capacitor C19 is connected between the VCC3 supply line and ground for the purpose of filtering VCC3.

The lock detect output at pin 1 of the PLL IC U2 is applied to a nonlinear filter 132. The non-linear filter 132 includes a combination of a resistor R39 in parallel with a series combination of a diode D2 and a resistor R40. This parallel combination is connected between the lock detect output and a capacitor C21 to ground. In operation, the capacitor C21 is charged through the resistor R39, and discharged through the parallel combination of the resistors R39 and R40. As a result, only valid lock detect signals which last longer than approximately 20 to 30 milliseconds are passed by the nonlinear filter 132.

The output of the nonlinear filter 132 is applied to the base of a transistor Q13 by a resistor R42. The emitter of the transistor Q13 is connected to ground. An open collector output is provided to a subsequent microprocessor at a WAKE line indicated in the schematic. As a result, the microprocessor is awakened upon receipt of a valid lock signal. The wake-up signal is disabled by the microprocessor by a transistor Q12, whose collector is applied to the output of the nonlinear filter 132, whose emitter is connected to ground, and whose base is coupled to the microprocessor circuit by a resistor R41. When the microprocessor is awake, a voltage is supplied to P2 which turns on the transistor Q12. As a result, the transistor Q13 is turned off in order to inhibit a new wake-up signal to be sent to the microprocessor when the microprocessor is awake.

Figure 4:
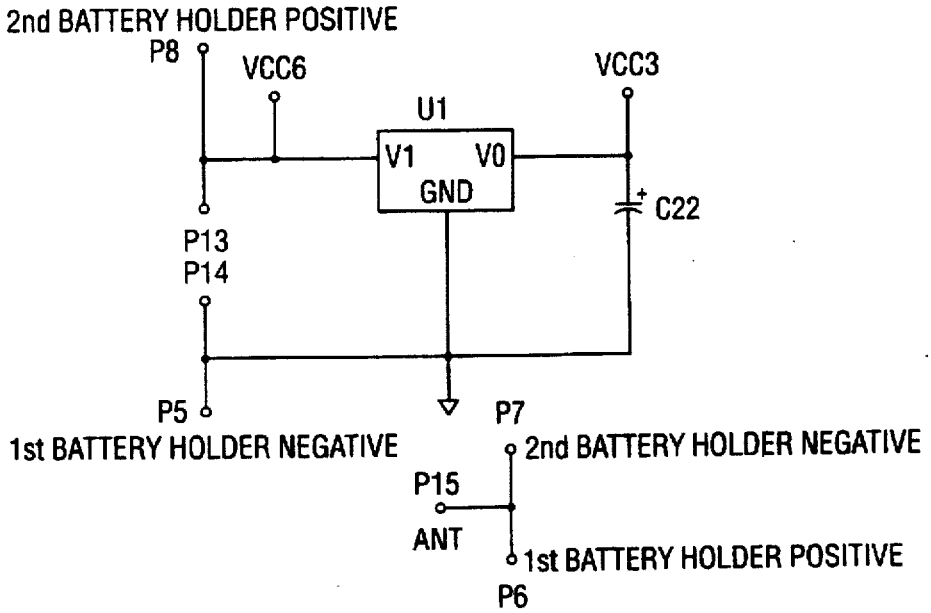
FIG. 4 is a schematic drawing of a battery circuit in accordance with the present invention.

FIG. 4 illustrates an embodiment of a battery supply circuit in accordance with the present invention. A 6 volt battery source is applied between terminals PB and P5. In a preferred embodiment, this 6 volt battery source is formed by a series combination of four "D" type cells, each producing 1.5 volts. The 6 volt source is applied directly to the VCC6 power supply line. A 3 volt source is generated by a low-current, voltage regulator U1, such as an 81230A6, in combination with a capacitor C22. The 3 volt source is applied to the VCC3 supply line.

Figure 5:
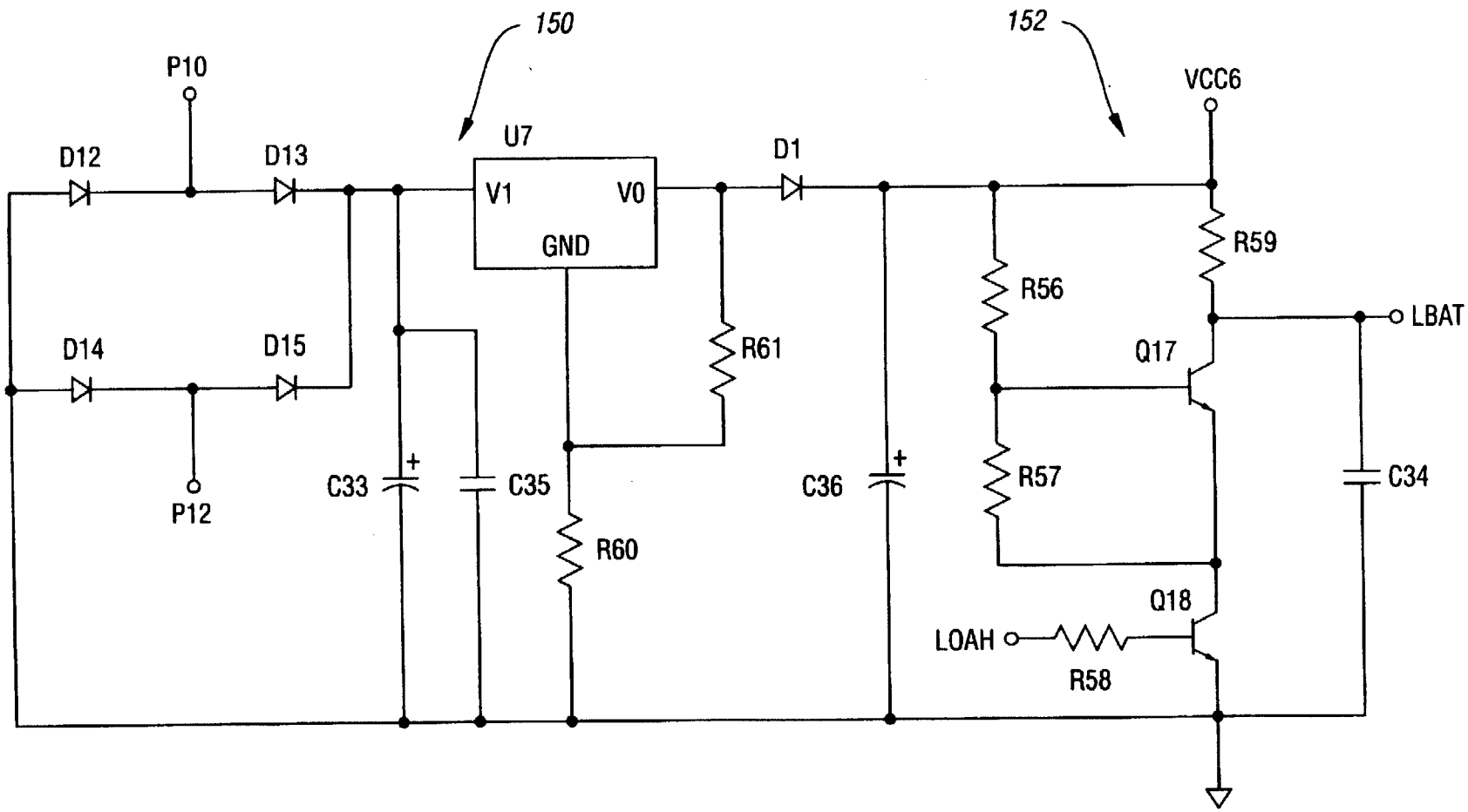
FIG. 5 is a schematic drawing of a power supply circuit in accordance with the present invention.

An embodiment of a power supply circuit in accordance with the present invention is illustrated by the schematic drawing in FIG. 5. The power supply circuit includes a low voltage alternating current (AC) power supply 150 which can be used to replace the batteries in situations where the user has an existing doorbell power circuit. The AC power supply 150 is comprised of a voltage regulator U7, diodes D1, D12, D13, D14, and D15, resistors R60 and R61, and capacitors C33 and C35. A low voltage AC signal, typically available from an existing doorbell power circuit, is applied at lines P10 and P12. Lines P10 and P12 are connected to a bridge rectifier, formed by the diodes D12, D13, D14, and D15, to provide a full-wave rectified version of the low voltage AC signal. The rectified signal is filtered by the capacitors C33 and C35, and applied to the input of the voltage regulator U7. In a preferred embodiment, an LM317 is employed as the voltage regulator U7. In order to set the output voltage of the voltage regulator U7, the adjust pin is coupled to the output pin by the resistor R61, and to ground by the resistor R60. The output of the voltage regulator U7 is coupled to the VCC6 supply line by the diode D1. The VCC6 supply line is filtered by the capacitor C36 connected between VCC6 and ground.

Further included in the power supply circuit is a low battery detector circuit 152. An activation signal from the microprocessor section is applied to a line indicated by LOAH. A resistor R58 couples the LOAH line to the base of a transistor Q18 whose emitter is grounded. The collector of the transistor Q18 is connected to the emitter of a transistor Q17. The collector of the transistor Q17 is coupled to VCC6 by a resistor R59, the base is coupled to VCC6 by a resistor R56, and the emitter is coupled to the base by a resistor R57. The collector of the transistor Q17 is coupled to a line indicated by LBAT. A capacitor C34 is coupled between the LBAT line and ground.

An application of an activation signal to LOAH causes the transistor Q18 to turn on. When the transistor Q18 is on, the voltage at the collector is pulled down near to ground, and current is allowed to flow through the collector. This activates the battery detector circuit formed using the transistor Q17. The voltage applied at the base of the transistor Q17 is the VCC6 voltage divided by the resistors R56 and R57. For VCC6 greater than a threshold determined by the resistors R56 and R57, the transistor Q17 turns on, resulting in a low voltage applied to the LBAT line. For VCC6 less than the threshold, the transistor Q17 is off, which results in a voltage approximately equal to VCC6 being applied to the LBAT line. In other words, a good battery causes LBAT to appear low to the microprocessor, and a weak battery causes LBAT to appear high to the microprocessor. In a preferred embodiment, the values of the resistors R56 and R57 are selected so that the transistor Q17 is turned on for VCC6 greater than approximately 3.2 volts.

Figure 6:
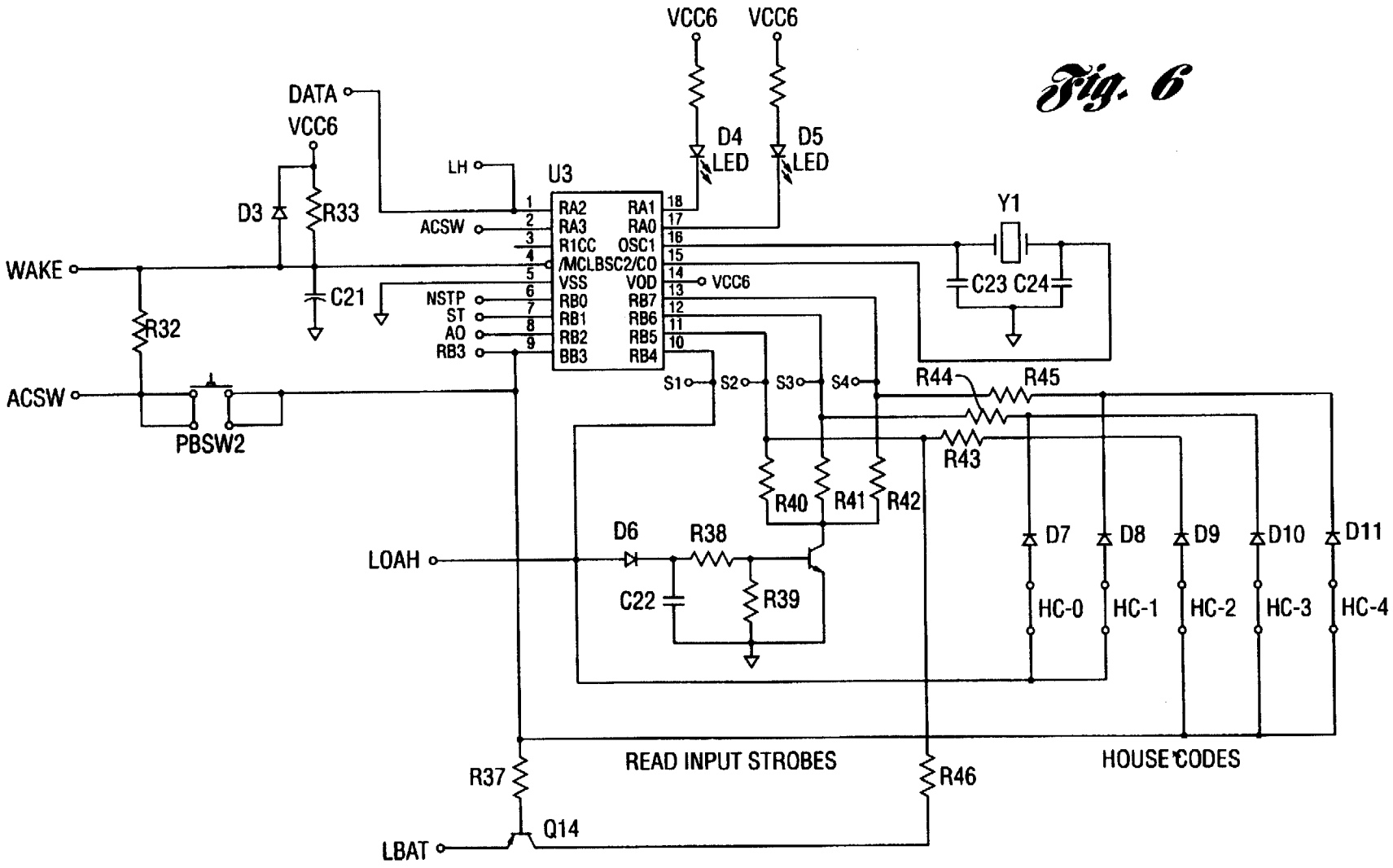
FIG. 6 is a schematic drawing of a micro-processor section in accordance with the present invention.

FIG. 6 illustrates an embodiment of a microprocessor section in accordance with the present invention. The microprocessor section includes a single chip microcontroller U3. The microcontroller U3, powered by the VCC6 supply line, normally operates in a low-current inactive mode, i.e. a sleep mode, until awaken via the WAKE line from the PLL circuit. The open collector output from the WAKE line is pulled up to VCC6 by a parallel combination of a diode D3 and a resistor R33. Additionally, a capacitor C21 is connected between the WAKE line and ground. Upon receipt of a valid wake-up signal along the WAKE line, the microcontroller is awaken and becomes active. Once awaken, the microcontroller U3 activates the LH line in order to prevent further wake-up pulses to be generated on the WAKE line.

When the microcontroller U3 is awake, a combination of a crystal Y1 and capacitors C23 and C24 is used to provide a clock signal to the microcontroller U3. In a preferred embodiment, the crystal Y1 is chosen to provide a 4 MHz clock signal.

While awake, the microcontroller U3 samples the DATA line for pulses formed by the RF circuit based upon signals transmitted by the transmitter. The modulation format employed in embodiments of the present invention utilizes pulse position modulation. A logical "one" is designated from a logical "zero" by the position of a fixed width pulse within a 6 millisecond bit interval. More specifically, a logical "one" is a 500 microsecond pulse approximately 2 milliseconds into the bit interval, and a logical "zero" is designated by a one millisecond pulse approximately 4 milliseconds into the bit interval.

The use of pulse position modulation allows the receiver to approximate an optimal matched filter detector. The microcontroller U3 samples the received data during each bit interval, and compares the signal energy in the first half of the bit period to the signal energy in the second half of the bit interval. If the energy in the first half of the bit interval exceeds the energy in the second half, the microcontroller U3 concludes that a logical "zero" was transmitted. Similarly, if the energy in the second half of the bit interval exceeds the energy in the first half, the microcontroller U3 concludes that a logical "one" was transmitted. If the energy in both the first half and the second half is significantly large, the microcontroller U3 concludes that the noise environment is too severe to make an accurate determination, and rejects the data. If the energy in both the first half and the second half is insignificant, then the microcontroller U3 concludes that no radio frequency signal was received during the bit interval.

Each data packet generated by the transmitter comprises a start bit, five song select bits, a low battery bit, five house code bits, and a stop bit. The stop bit is selected to be a blank bit, i.e. the absence of a radio frequency signal during a bit interval. If the microcontroller U3 detects additional data within the stop bit time of a data packet, then the entire data word is ignored.

After demodulating each bit in the data packet and detecting a blank bit within the stop bit time, a parity check is performed over the low battery bit and the song select bits. If the parity passes, then the transmitted house code is compared to the house code in the receiver defined by jumpers HC0, HC1, HC2, HC3, and HC4. The user sets the house code in the receiver by selectively cutting a combination of the jumpers HC0 to HC4.

Each of the jumpers HC0 and HC1 couples the anode of a corresponding one of diodes D7 and D8, respectively, to the RB4 pin of the microcontroller U3. The cathode of the diode D7 is coupled to the RB6 pin by a resistor R44, and the cathode of the diode D8 is coupled to the RB7 pin by a resistor R45. In a similar manner, each of the jumpers HC2, HC3, and HC4 couples the anode of a corresponding one of diodes D9, D10, and D11, respectively, to the RB3 pin of the microcontroller U3. The anode of the diode D9 is coupled to the RB5 pin by a resistor R43, the anode of the diode D10 is coupled to the RB6 pin by the resistor R44, and the anode of the diode D11 is coupled to the RB7 pin by the resistor R45. Using this arrangement, the microcontroller U3 determines the status of the jumpers by measuring the signals at the RB5, RB6, and RB7 pins in response to independent strobe signals generated out of pins RB3 and RB4.

If the transmitted house codes match the house code in the receiver, then the microcontroller U3 next checks the status of the receiver battery. The microcontroller U3 strobes the LOAH line, which is connected to pin RB4, to enable the low battery detector circuit 152 in FIG. 5. The low battery detector circuit 152 provides a signal indicative of the battery status along the LBAT line. The LBAT line is coupled to the microcontroller U3 by a transistor Q14 and resistors R37 and R46.

After checking the status of the receiver battery, the microcontroller U3 commands a subsequent music section to play the appropriate song indicated by the five song bits. If either a low battery bit flag is detected in the transmitted word or the receiver battery is determined to be weak, then the microcontroller U3 further commands the music IC to play a beep, or another suitable audible indication, after the completion of the selected song. The microcontroller U3 then sets an internal register indicative of which battery, either from the transmitter or the receiver, caused the low battery indication. After the music is played and the internal register is set, the microcontroller U3 goes back to sleep.

A switch S1 is included to allow a user to check the status of both the receiver battery and the transmitter battery. A user would typically check the battery status upon hearing the additional beep after the selected song. The switch S1 is coupled to the WAKE line by a resistor R32 so that a wake-up pulse is applied to the microcontroller U3 in response to depressing the switch S1. After waking up, the microcontroller U3 checks the internal battery status register and selectively illuminates light-emitting diodes (LEDs) D4 and D5 coupled to the microcontroller U3. The illumination of both LEDs D4 and D5 indicates that both the receiver battery and the transmitter battery are sufficiently powered. If either the receiver battery or the transmitter battery is weak, the corresponding LED is left dark. In a preferred embodiment, the microcontroller U3 rechecks the receiver battery whenever the switch S1 is depressed.

Figure 7:
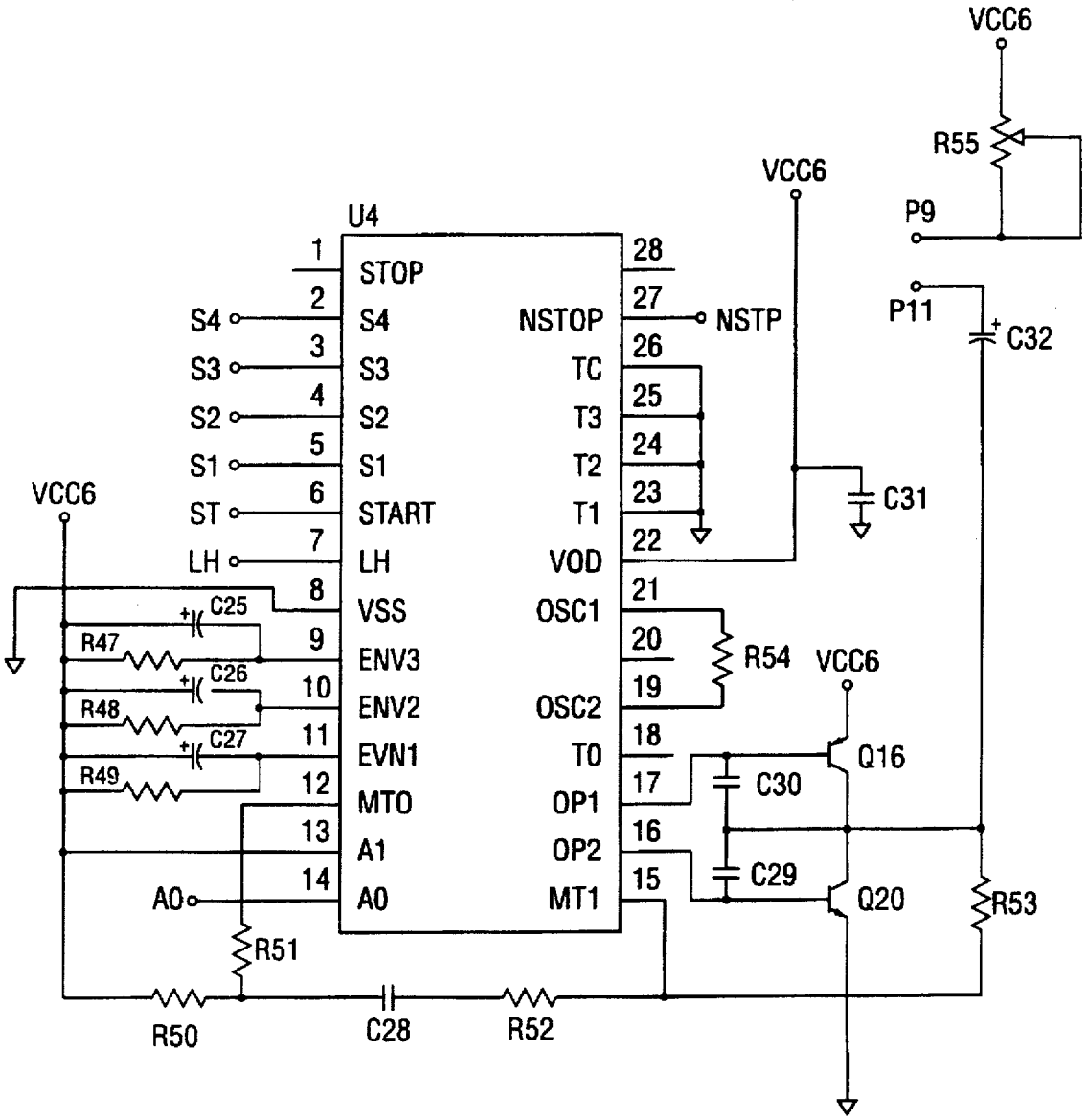
FIG. 7 is a schematic drawing of a music section in accordance with the present invention.

An embodiment of a music section in accordance with the present invention is illustrated by the schematic drawing in FIG. 7. The music section comprises a music integrated circuit U4, such as an M1131AJN available from NPC. The music integrated circuit U4 is wired in accordance with a standard application provided for by the manufacturer. The microprocessor section commands the music section to play a song using lines LH, ST, S1, S2, S3, and S4. The music integrated circuit U4 executes and plays the song using a speaker connected between lines P9 and P11.

Figure 8:
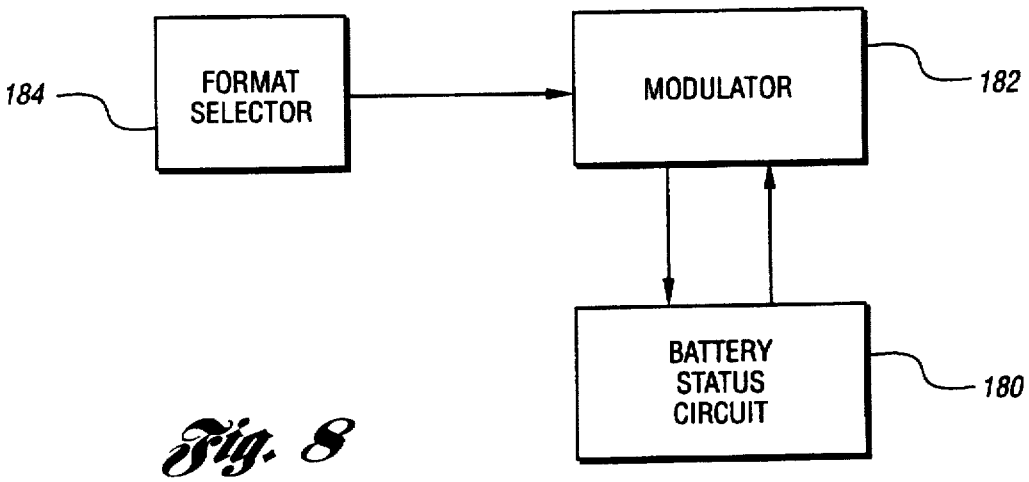
FIG. 8 is a block diagram of an embodiment of a transmitter in accordance with the present invention.

A block diagram of an embodiment of a transmitter in accordance with the present invention is shown in FIG. 8. The transmitter is for use with a corresponding receiver, which produces an audible indication in response to receiving a radio frequency signal from the transmitter. A battery status circuit 180 verifies the status of a battery source of power within the transmitter. The battery status circuit produces a status signal in dependence upon the status of the battery source to a modulator 182. The modulator 182 produces the radio frequency signal such that the information pertaining to the status of the battery source is modulated thereon. In preferred embodiments, a battery status bit representative of the status of the battery source is modulated onto the radio frequency signal. A format selector 184, which allows the user to select a particular modulation format to be employed, is coupled to the modulator 182. In preferred embodiments, the format selector 184 includes jumper wires which are selectively severed by the user to choose the modulation format. The format selector 184 allows the transmitter to be used with a variety of different types of receiver.

FIG. 9 is a schematic drawing of an embodiment of a transmitter in accordance with the present invention. The transmitter includes a microprocessor U1 which normally operates in an inactive mode, i.e. a sleep state. A first switch S1, used for sound select scrolling, and a second switch S2, used for activation, are coupled to the microprocessor U1. Depressing either of the first switch S1 or the second switch S2 causes the microprocessor U1 to awaken. A crystal Y1 is used to provide a clock signal to the microprocessor U1 while awake. In a preferred embodiment, the crystal Y1 is selected to provide a 4 MHz clock signal.

Upon awakening, the microprocessor U1 reads a house code defined by jumpers J0, J1, J2, J3, and J4. The user sets the house code in the transmitter by selectively cutting a combination of the jumpers J0 to J4. Each of the jumpers J0 to J4 provide a coupling between two input/output lines of the microprocessor U1. More specifically, the RB7 pin is coupled to the RB2 pin by the jumper J0 in series with a single diode from a switching dual diode D3, the RB4 pin is coupled to the RB3 pin by the jumper J0 in series with a first diode from a switching dual diode D4, the RB5 pin is coupled to the RB3 pin by the jumper J0 in series with a second diode from a switching dual diode D4, the RB6 pin is coupled to the RB3 pin by the jumper J0 in series with a first diode from a switching dual diode D5, and the RB7 pin is coupled to the RB3 pin by the jumper J0 in series with a second diode from a switching dual diode D5. Further, resistors R12, R13, R14, and R15 provide a coupling between ground and pins RB4, RB5, RB6, and RB7, respectively. Using this arrangement, the microprocessor U1 determines the status of the jumpers by monitoring the signals at RB4, RB5, RB6, and RB7 in response to independent strobe signals generated out of pins RB2 and RB3.

The microprocessor U1 next reads a transmission code defined by jumpers TX1 and TX2. The user sets the transmission code by selectively cutting a combination of the jumpers TX1 and TX2. The RB5 pin is coupled to the RB2 pin by the jumper TX1 in series with a first diode from a switching dual diode D2, and the RB6 pin is coupled to the RB2 pin by the jumper TX2 in series with a second diode from a switching dual diode D2. The microprocessor U1 determines the status of the jumpers TX1 and TX2 in a similar manner as with the jumpers J0 to J4.

The status of the battery in the transmitter is verified by a low battery detector circuit 200. An activation signal from the microprocessor U1 is applied to a line indicated as LBAT. A resistor R11 couples the LBAT line to the base of a transistor Q3 whose emitter is grounded. The collector of the transistor Q3 is connected to the emitter of a transistor Q2. The collector of the transistor Q2 is coupled to VCC by a resistor R9, the base is coupled to VCC by a resistor R8, and the emitter is coupled to the base by a resistor R10. The collector of the transistor Q2 is coupled to a line indicated as LOW. The LOW line is applied as an input to the microprocessor U1.

The low battery detector circuit 200 operates in the same manner as the low battery detector circuit 152 in FIG. 5. To summarize, a battery having a voltage below a preselected threshold causes the LOW line to appear high in response to an activation signal generated by the microprocessor U1 along the LBAT line. The signal generated along the LOW line is used by the microprocessor U1 in forming a low battery bit which is transmitted within a command word.

The modulation signal format of the transmitter is dependent upon the status of the jumpers TX1 and TX2. In a first format, the transmitter is capable of communicating with two different types of receiver. For a first receiver type, a 1 kHz wake-up tone is transmitted for a duration of 100 milliseconds. Next, two complete commands words for the first receiver type are transmitted, wherein each command word includes a start bit, five song select bits, a low battery bit, five house code bits, a parity bit, and a stop bit. This is followed by a transmission of two complete commands words for a second receiver type. The pattern of transmitting a wake-up tone, two complete command words for the first receiver type, and two complete command words for the second receiver type is executed three times. In an exemplary embodiment, the first format is employed when both of the jumpers TX1 and TX2 are unsevered.

In a second format, the transmitter is capable of communicating with the same two receiver types as the first format.

However, the order of the transmitted words is reversed. More specifically, a pattern of transmitting two complete command words for the second receiver type, a wake-up tone, and two complete command words for the first receiver type is performed three times. In an exemplary embodiment, the second format is employed when both of the jumpers TX1 and TX2 are severed.

The command words for the first receiver type are modulated using pulse position modulation. A logical "one" is designated from a logical "zero" by the position of a fixed width pulse within a 6 millisecond bit interval. More specifically, a logical "one" is a 500 microsecond pulse approximately 2 milliseconds into the bit interval, and a logical "zero" is designated by a one millisecond pulse approximately 4 milliseconds into the bit interval. Also, the parity bit is a cyclical redundancy check bit computed over the low battery bit and the five house code bits.

In a third format, the transmitter is capable of communicating with an analog receiver. A logical AND operation is performed on two audio tones, each having a corresponding predetermined frequency, to form a dual-tone signal. The dual-tone signal is transmitted as long as the switch S2 is depressed. In an exemplary embodiment, the third format is employed when the jumper TX1 is severed and the jumper TX2 is not severed.

In a fourth format, the transmitter is capable of communicating with a similar analog receiver as with the third format. A logical AND operation is performed on two audio tones, each having a corresponding predetermined frequency, to form a dual-tone signal. The predetermined frequencies for the fourth format are selected to be different from those employed in the third format. The dual-tone signal is transmitted as long as the switch S2 is depressed. In an exemplary embodiment, the fourth format is employed when the jumper TX1 is not severed and the jumper TX2 is severed.

Next, the microprocessor U1 checks an internal song select status register. The internal song select status register, which contains the current song selection code to be transmitted, is maintained even when the microprocessor U1 is in its inactive state. If the switch S1, the scroll switch, was the depressed switch, then the song select code is incremented and the modulation signal in accordance with the status of jumpers TX1 and TX2 is produced along a line indicated as XOUT. If the switch S2, the activation switch, was depressed, then the modulation signal in accordance with the status of jumpers TX1 and TX2 is produced along the XOUT line, without changing the song selection code.

The transmitter includes an oscillator circuit 202, coupled to the XOUT line, which is used to generate and modulate a radio frequency carrier signal. In the embodiment of FIG. 8, the oscillator circuit 202 is based upon a Colpitts oscillator design. The oscillator circuit 202 includes a transistor Q1 whose emitter is coupled to ground by a parallel combination of a resistor R3 and a capacitor C3. The base of the transistor Q1 is coupled to a VCC' supply line by a capacitor C1, to ground by a resistor R2, and to the XOUT line by a resistor R1. The collector of the transistor Q1 is coupled to the VCC' supply line by a parallel combination of an inductor loop, a capacitor C5, and a variable capacitor C2. The variable capacitor C2 allows the oscillator to be tuned to its desired carrier frequency. In a preferred embodiment, this carrier frequency is 315 MHz. The VCC' supply line is coupled to a VCC power line by an inductor L1. In operation, the transmitter transmits a carrier signal, via an antenna ANT1, which is amplitude modulated by the signal from the XOUT line.

Using a transmitter and a receiver in accordance with the present invention, a user sets the house code by cutting jumper wires. The house code is used to separate different transmitter/receiver systems from interfering with each other, as would occur with different apartments within one building, for example. In an illustrated embodiment, up to 32 separate systems within a common radio range can be operated independently using distinct house codes.

The sound code is used to distinguish between one or more transmitters intended to operate the same receiver. For example, a different sound can be used to differentiate the front door from the back door. The song code is customer selectable and stored in the transmitter by use of a scroll button. In an illustrated embodiment, up to 12 distinct transmitters can be distinguished. The receiver acts as a peripheral device to the transmitter in that it simply plays the sound which has been commanded.

Upon each transmission, the transmitter verifies the status of its batteries and communicates the status to the receiver. Similarly, the receiver verifies the status of its own batteries upon every activation. If a low battery condition is detected in either the transmitter or the receiver, an additional high frequency "beep" tone is played after completion of the specified song. This "beep" informs the user that there is a weak battery in the system. To determine which battery is weak, the user depresses a button on the receiver and views two LEDs, one LED corresponding to the receiver and one LED corresponding to the transmitter, which illuminate in dependence upon the status of the batteries. Since a unique song is specified with each transmitter, the user can determine which of the transmitters has a weak battery if a weak transmitter battery indication is given.

Embodiments of the present invention have many advantages. First, the maximum energy criterion used in demodulating the pulse position modulation signals aids in improving the transmission range and preventing errors under extreme conditions. Since statistically noise will tend to be correlated over a longer interval than 500 microseconds, any noise will be averaged across both pulse intervals.

Another advantage is the extended battery life which is exhibited by embodiments of the receiver. The extended battery life results from including a PLL wake-up circuit which activates the microprocessor and music IC only when required. The battery life is further extended by regulating a 6 volt battery source down to 3 volts for running the RF and signal processing circuits. As a result, the battery in the receiver can be drawn down to half of its full power voltage without affecting the operation of these circuits in the receiver. Also, a low battery detector in the receiver only draws battery current when commanded by the microprocessor.

Moreover, the battery life in the receiver is extended by employing transistor-based signal processing circuits rather than op-amp-based circuits. Specifically, the discrete comparator circuit and the active peak detector are of importance in this regard.

A further advantage is the ability of the transmitter to communicate with a variety of different receivers in dependence upon the status of jumper lines contained therein. A user can selective cut a combination of the jumper lines in order to employ the transmitter with a specific receiver type. The jumper lines perform the same function as standard DIP switches, but at a reduced cost to manufacture.

It is noted that the teaching of the above-described embodiments are also applicable to a general wireless actuator system. Such a system includes a transmitter capable of transmitting a radio frequency signal, and a receiver which actuates a device in response to receiving the transmitted RF signal. In place of a sound generator, the receiver includes an actuator which actuates the device in dependence upon an electrical signal.

While the best mode for carrying out the invention has been described in detail, those familiar with the art to which this invention relates will recognize various alternative designs and embodiments for practicing the invention as defined by the following claims.

What is claimed is:

1. A receiver for use in a wireless actuator system with a corresponding transmitter, the corresponding transmitter for transmitting a radio frequency signal, the receiver comprising:

a radio frequency detector which produces an intermediate signal upon receiving the radio frequency signal from the corresponding transmitter;

a demodulator, coupled to the radio frequency detector, which forms a discrete signal by comparing a first quantity to a second quantity, wherein the first quantity is representative of a behavior of the intermediate signal during a predefined first time interval and the second quantity is representative of a behavior of the intermediate signal during a predefined second time interval;

an actuator, coupled to the demodulator, which actuates a device in dependence upon the discrete signal;

wherein the demodulator rejects the radio frequency signal if the first quantity exceeds a first threshold and the second quantity exceeds a second threshold.

2. The receiver of claim 1 wherein the first quantity is representative of signal energy.

3. The receiver of claim 1 wherein the first time interval and the second time interval are nonoverlapping.

4. The receiver of claim 1 wherein the first time interval and the second time interval are each within a predetermined bit interval.

5. The receiver of claim 1 wherein the demodulator senses a stop signal when the first quantity is less than a first threshold and the second quantity is less than a second threshold.

6. A receiver for use in an audible indication system with a corresponding transmitter, the corresponding transmitter for transmitting a radio frequency signal, the receiver comprising:

a radio frequency detector which produces an intermediate signal upon receiving the radio frequency signal from the corresponding transmitter;

a demodulator, coupled to the radio frequency detector, which forms a discrete signal by comparing a first quantity to a second quantity, wherein the first quantity is representative of an energy of the intermediate signal during a predefined first time interval and the second quantity is representative of an energy of the intermediate signal during a predefined second time interval, wherein the first time interval and the second time interval are nonoverlapping within a predetermined bit interval; and a sound generator, coupled to the demodulator, which generates an audible indication in dependence upon the discrete signal;

wherein the demodulator rejects the radio frequency signal if the first quantity exceeds a first threshold and the second quantity exceeds a second threshold, and wherein the demodulator senses a stop signal when the first quantity is less than a third threshold and the second quantity is less than a fourth threshold.

7. A receiver for use in a wireless actuator system with a corresponding transmitter, the corresponding transmitter for transmitting a radio frequency signal, the receiver comprising:

a radio frequency detector which produces an intermediate signal upon receiving the radio frequency signal from the corresponding transmitter;

a demodulator, coupled to the radio frequency detector, which forms a discrete signal by comparing a first quantity to a second quantity, wherein the first quantity is representative of a behavior of the intermediate signal during a predefined first time interval and the second quantity is representative of a behavior of the intermediate signal during a predefined second time interval; and an actuator, coupled to the demodulator, which actuates a device in dependence upon the discrete signal;

wherein the demodulator senses a stop signal when the first quantity is less than a first threshold and the second quantity is less than a second threshold.

8. The receiver of claim 7 wherein the first quantity is representative of signal energy.

9. The receiver of claim 7 wherein the first time interval and the second time interval are nonoverlapping.

10. The receiver of claim 7 wherein the first time interval and the second time interval are each within a predetermined bit interval.

11. The receiver of claim 7 wherein the demodulator rejects the radio frequency signal if the first quantity exceeds a first threshold and the second quantity exceeds a second threshold.

12. A transmitter for use in an audible indication system, comprising:

a modulator for producing a first radio frequency signal in a first modulation format and for producing a second radio frequency signal in a second modulation format using a single carrier frequency; and a format selector, coupled to the modulator, which allows a selection of at least one format of the first modulation format and the second modulation format;

wherein the transmitter communicates with at least one of a first corresponding receiver and a second corresponding receiver based upon the selection of the at least one format, wherein the first corresponding receiver produces an audible indication in response to receiving the first radio frequency signal, and wherein the second corresponding receiver is capable of producing an audible indication in response to receiving the second radio frequency signal.

13. The transmitter of claim 12 wherein the first modulation format includes a pulse position modulation of a plurality of bits.

14. The transmitter of claim 12 wherein the format selector includes at least one jumper wire, wherein the selection of the at least one format is modified by severing the at least one jumper wire.

15. The receiver of claim 1 wherein the actuator actuates a sound generator to generate an audible indication in dependence upon the discrete signal.

16. The receiver of claim 7 wherein the actuator actuates a sound generator to generate an audible indication in dependence upon the discrete signal.

* * * * *